US005259729A

United States Patent [19]

Fujihira et al.

[11] Patent Number: 5,259,729

[45] Date of Patent: Nov. 9, 1993

[54] PROPELLER BLADE TIP PATH PLANE INCLINING DEVICE

[75] Inventors: Yuji Fujihira, Osaka; Ryoichi Sasaki, Shiga; Masaru Ando, Osaka, all of Japan

[73] Assignee: Keyence Corporation, Osaka, Japan

[21] Appl. No.: 856,732

[22] Filed: Mar. 24, 1992

[30] Foreign Application Priority Data

May 31, 1991 [JP] Japan ..... 3-229846

[51] Int. Cl.[5] ..... A63H 27/133

[52] U.S. Cl. ..... 416/25; 416/61; 416/131; 416/162; 446/36

[58] Field of Search ..... 416/25, 30, 61, 102, 416/131, 162; 446/36, 37

[56] References Cited

U.S. PATENT DOCUMENTS 3,515,485 6/1970 Frank ..... 416/61
4,729,753 3/1988 Neathery et al. ..... 416/148
5,110,314 5/1992 Fujihara et al. ..... 446/36

FOREIGN PATENT DOCUMENTS 2837304 3/1979 Fed. Rep. of Germany .
2116928 10/1983 United Kingdom .

*Primary Examiner*—Edward K. Look
*Assistant Examiner*—James A. Larson
*Attorney, Agent, or Firm*—Sughrue, Mion, Zinn, Macpeak & Seas

[57] ABSTRACT

A propeller blade tip path plane-inclining device which is provided with a fuselage, a propeller including a center piece rotating unitary with a rotation shaft in association therewith and a plurality of blades extending substantially horizontally from the center piece and differing the variation in pitch during the rotation thereof from one another, a motor for driving the propeller for rotation, a position detector for detecting the position of the propeller in the propeller rotation plane, and a control device for controlling the motor in accordance with an output signal of the position detector.

12 Claims, 7 Drawing Sheets

PROPELLER BLADE TIP PATH PLANE INCLINING DEVICE

BACKGROUND OF THE INVENTION

1. Field of the Invention

The present invention relates to a toy having a propeller as a propulsive force and, more particularly to a device for inclining a propeller blade tip path plane in an orbit of a tip end of the propeller blade to produce a propulsive force for use in a toy helicopter or the like.

2. Related Art

In a toy helicopter or the like in which the rotation of a propeller lifts the fuselage and produces a propulsive force to fly the helicopter, propulsive force in a desired direction is obtained by inclining the tip path plane of the rotating propeller blade, thereby driving the helicopter.

The conventional device for inclining the tip path plane of the propeller blade is effected by various methods, one example of which is illustrated in FIG. 14.

Blades c of identical shape are symmetrically mounted on a rotation shaft b connected to a motor (not shown) mounted within a fuselage a. The blades c are provided at a base end of the rotation shaft with a flapping hinge or formed of a flexible material so that a flapping operation can be obtained by the buoyant force of the rotating blades in accordance with the rotational pitch thereof. A swash plate d is composed of two discs, which constitute a rotatable disc d1 and a non-rotatable disc d2, respectively. One end of each of the blades c is connected to this rotatable disc d1 through respective pitch links e.

The non-rotatable disc d2 of the swash plate d can be inclined by control rods f, and the rotatable disc d1 of the swash plate d can be inclined together with the non-rotatable disc d2.

When the swash plate d is inclined by operating the control rods f, the rotating blades c are periodically varied in pitch, so that the tip path plane of rotation of the blades c is inclined relative to the rotation shaft b by the flapping operation in accordance with the pitch of the blades c.

The conventional device for inclining the tip path plane of the rotating blades constructed as described above requires the inclining mechanism composed of the swash plate d, the pitch links e and the control rods f, and hence the device is complicated and the assembly operation is cumbersome.

Further, a model helicopter or the like is required to be of a small size and light in weight so as to more easily lift the fuselage to allow the helicopter to fly easily. In the case where the above complicated device is incorporated, these requirements are difficult to meet. Moreover, the overall cost is high.

The present inventors have proposed a propeller blade tip path plane inclining device for overcoming the aforementioned difficulties accompanying the conventional device, as disclosed in the coassigned U.S. patent application No. 07/610,652 (allowed on Dec. 16, 1991), U.S. Pat. No. 5,110,314.

SUMMARY OF THE INVENTION

With the above problems in view, it is an object of the invention to provide a propeller blade tip path plane-inclining device for use in a toy having a propeller in which the tip path plane of a rotating propeller can be inclined by an electrical control to accurately control the toy, and the number of components or parts is reduced to achieve a small-sized and lightweight design, as well as low cost.

The above, as well as other objects of the invention, are met by a propeller blade tip path plane-inclining device which is provided with a propeller including a center piece rotating unit with an associated rotation shaft and a plurality of blades extending substantially horizontally from the center piece rotating unit, such that the variation in pitch of each blade is different during rotation, a motor for driving the propeller for rotation, a position detector for detecting the position of the propeller in the tip path plane, and a control device for controlling the motor in accordance with an output signal of the position detector.

The center portion of the center piece rotating unit is supported by the rotation shaft and is capable of pivoting in the direction of the variation in pitch of the rotating blades. Further, the center piece rotating unit is connected to a rotation piece by a flexible connecting member at a point eccentric from the center point of the center piece rotating unit. The propeller having such a center piece rotating unit from which blades extend can be utilized for obtaining the object of the present invention.

The control device outputs a pulse signal for driving the motor, and increases and decreases the pulse width of the pulse signal at predetermined regions during propeller rotation in accordance with a signal output from the position detector to thereby achieve the desired inclination of the tip path plane of the rotating propeller utilizing the difference in the pitch variation of each of the blades.

The propeller blade tip path plane-inclining device for use in a toy having the propeller according to the present invention is constructed as described above, that is, the position of the rotating propeller is detected for driving the motor in accordance with a detection signal to control the inclination of the tip path plane of the rotating propeller blades. The position detector may include a magnet and a magnetic sensor disposed in connection with the rotation shaft for detecting the position of the rotating blades of the propeller. The motor is driven by the control device to rotate the blades in a desired periodical eccentric rotation in accordance with output signals of the position detector.

The pitch of each of the propeller blades varies in accordance with air resistance which is in proportion to the rotational speed of the blades. The plurality of blades are provided in such a manner that the variation of pitch of each of the blades differs from one another. Therefore, when the blades rotate eccentrically (eccentrically in rotational torque in case of propeller having 5 a large moment), the pitch of the rotating blades varies periodically and the tip path plane of the propeller is inclined accordingly.

DESCRIPTION OF THE PREFERRED EMBODIMENTS

Figure 1:
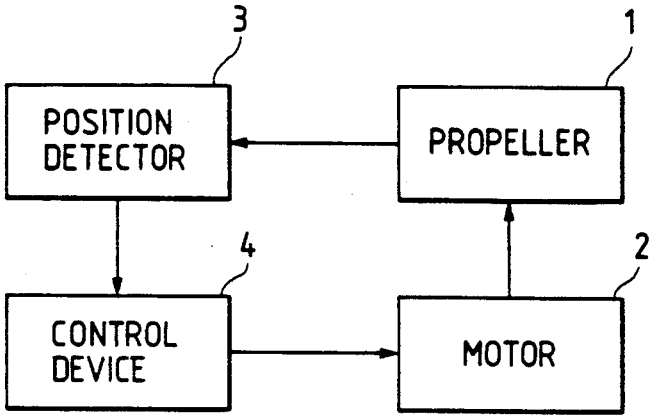
FIG. 1 is a schematic block diagram of a device for inclining a tip path plane of rotating propeller, provided in accordance with the present invention.

FIG. 1 is a schematic block diagram of a propeller blade tip path plane-inclining device, provided in accordance with the present invention.

A propeller blade tip path plane-inclining device of the present invention is provided with a propeller 1 having a center piece rotating unit with a rotation shaft in association therewith and a plurality of blades extending substantially horizontally from the center piece rotating unit where the plurality of blades have different variations in pitch during rotation, a motor 2 for driving the propeller 1 for rotation, a position detector 3 for detecting the position of the propeller in the propeller rotation plane, and a control device 4 for controlling the motor 2 in accordance with an output signal of the position detector 3.

Figure 2:
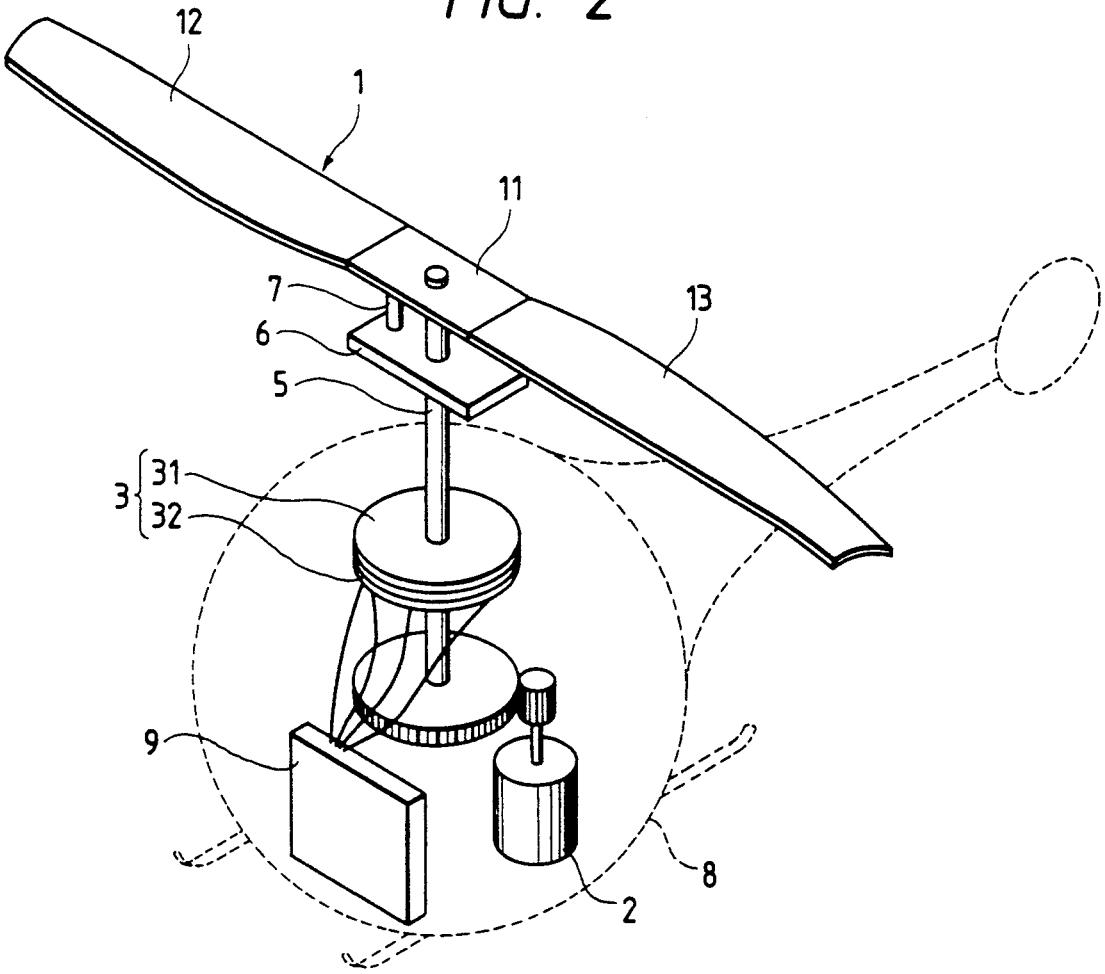
FIG. 2 is a schematic view of the main parts of the inclination device of the first embodiment of the invention.
Figure 3:
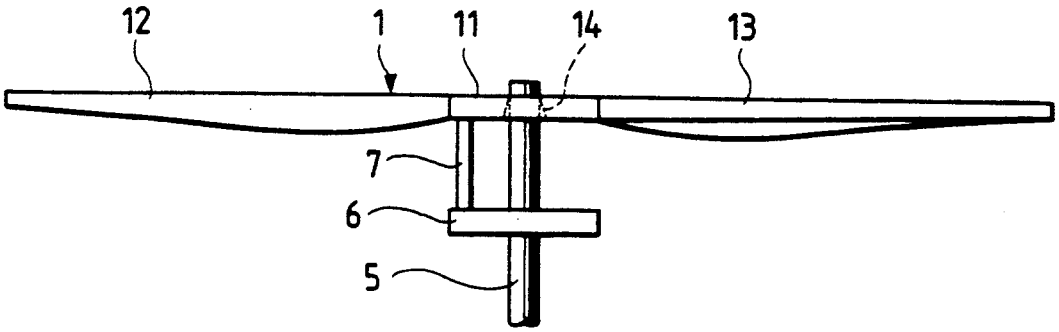
FIG. 3 is a side view of the propeller shown in FIG. 2.

FIGS. 2 and 3 show a first embodiment of the invention, specifically, FIG. 2 is a perspective view of the main components of the inclination device of the first embodiment of the present invention, and FIG. 3 is a side view of the propeller shown in FIG. 2.

The propeller 1 is provided with a center piece rotating unit 11 and blades 12, 13 extending substantially horizontally from the center piece rotating unit 11, which rotate together with the rotation shaft 5.

A through hole 14 allowing the propeller 1 to pivot is formed at a center portion of the center piece rotating unit 11. The inner surface of the through hole 14 contacts the outer surface of the rotation shaft 5. The propeller 1 is supported on the rotation shaft 5 through the through hole 14 such that the propeller 1 is capable of pivoting in response to pitch variation of the blades 12, 13.

A rotation piece 6 connects to the center piece rotating unit 11 by means of a connecting member 7 secured to the center piece rotating unit 11 of the propeller 1 at an eccentric position of the center piece rotating unit 11 with respect to the rotation shaft 5. The connecting member 7 is formed of a flexible material and bends in the direction caused by the pitch variation of the blades 12, 13 according to the rotation of the propeller 1 so that the pitch variation of the blade 12 and the blade 13 becomes asymmetric.

Figure 8:
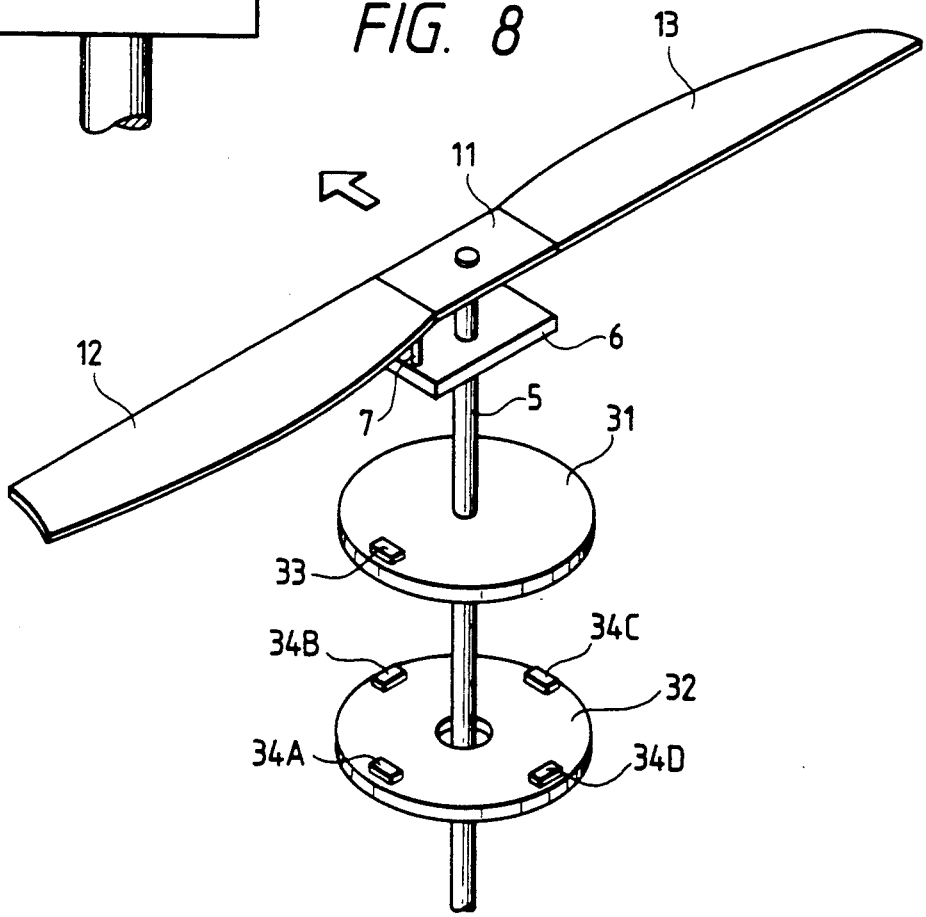
FIG. 8 is an enlarged schematic view showing essential parts of the device of the invention according to the first embodiment of the invention.

A motor 2 is mounted inside a fuselage 8 for driving the propeller 1 to rotate directly or through a gear engagement or the like. A position detector 3 is constituted by a rotatable disc 31 mounted coaxially on the rotation shaft 5 of the propeller 1, and rotates together with the rotation shaft, and a non-rotatable disc 32 fixed to the fuselage 8 at a position adjacent to the rotatable disc 31. As shown in FIG. 8, a magnet 33 is mounted on the rotatable disc 31 whereas magnetic sensors 34A, 34B, 34C and 34D are mounted on the non-rotatable disc 32 and vertically aligned with an orbit of the rotation of the magnet 33.

A control circuit 9 is provided for receiving the detection signals of the magnetic sensors 34 and for generating a pulse signal in accordance with the detection signals to drive the motor 2 to rotate.

Figure 4:
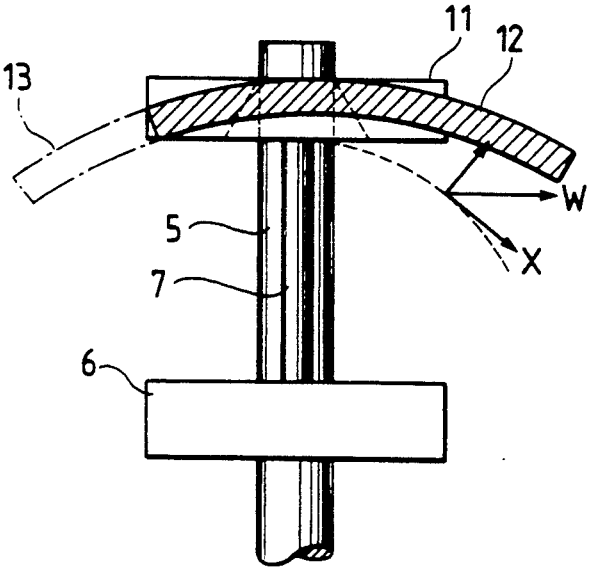
FIG. 4 is a side view showing an operation of the propeller according to the invention.
Figure 5:
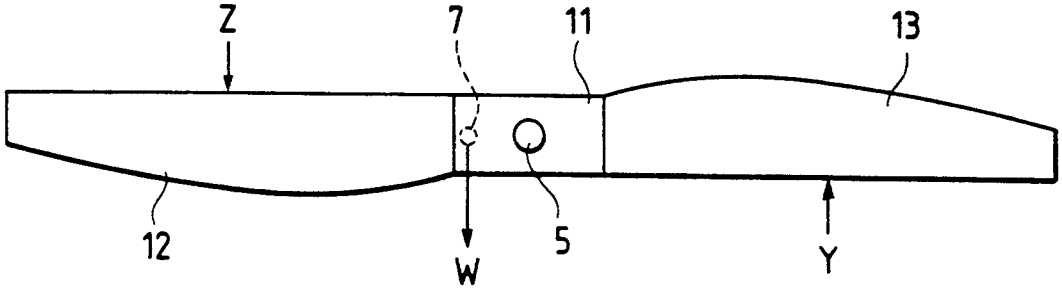
FIG. 5 shows moment forces applied to the blades of the invention.
Figure 6:
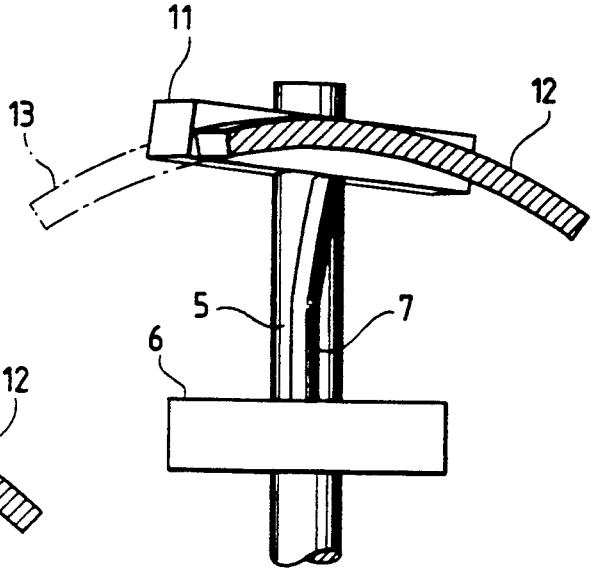
FIGS. 6 and 7 are side views showing an operation of the propeller according to the invention.
Figure 7:
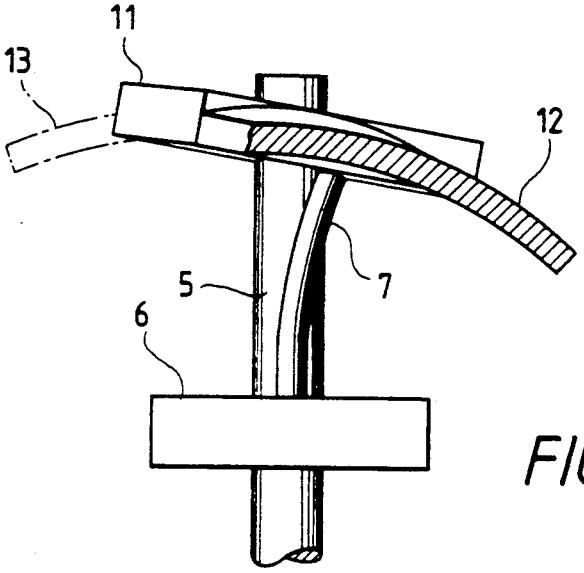

The propeller 1 is designed in such a manner that the pitch variation of blade 12 is smaller than that of blade 13 when the blades 12, 13 are not rotating, as shown in FIG. 4. When the propeller 1 is driven to rotate by the motor 2, the propeller receives a pressure caused by air resistance directed opposite the rotational direction of the propeller, which pressure produces a force W applied to an end of the connecting member 7. Since the propeller 1 is supported by the rotation shaft 5 through the center piece rotating unit 11, the force W applied to the connecting member 7 is a resultant force of a moment of force Z applied to the blade 12 and a moment of force Y applied to the blade 13 as shown in FIG. 5. In this condition, the connecting member 7 bends by an amount determined by a divided force X of the force W, since the connecting member 7 is formed of a flexible material. When the connecting member 7 bends, the propeller 1 itself pivots with respect to the rotation shaft 5 by means of the through hole 14 so that the pitch of the blade 12 increases while the pitch of the blade 13 decreases. As a result, both the pitch of blades 12 and 13 become the same. In this condition, if the rotating speed of the motor 2 increases further, the force W applied to the connecting member 7 becomes larger and at the same time the pivotal movement of the propeller 1 increases further and, as a result, the pitch of the blade 12 becomes larger than that of the blade 13 as shown in FIG. 7.

FIG. 8 is an enlarged perspective view showing essential parts of the device according to the first embodiment of the invention. An arrow shown in FIG. 8 directs to a front direction of the fuselage 8.

As is apparent from FIG. 8, a magnet 33 is mounted on the rotatable disc 31 at a position on the outer edge of the rotatable disc 31. On the other hand, magnetic sensors 34A, 34B, 34C and 34D are mounted on the non-rotatable disc 32 at four positions, that is, leftside, frontside, rightside and rearside positions, respectively, with respect to the fuselage 8. In this case, the propeller 1 rotates clockwise. Each of the magnetic sensors 34 outputs a detection signal when the magnet 33 mounted on the rotatable disc 31 approaches each of the sensors. That is, each of the sensors 34 outputs one pulse signal during one rotation of the rotatable disc 31.

Figure 9:
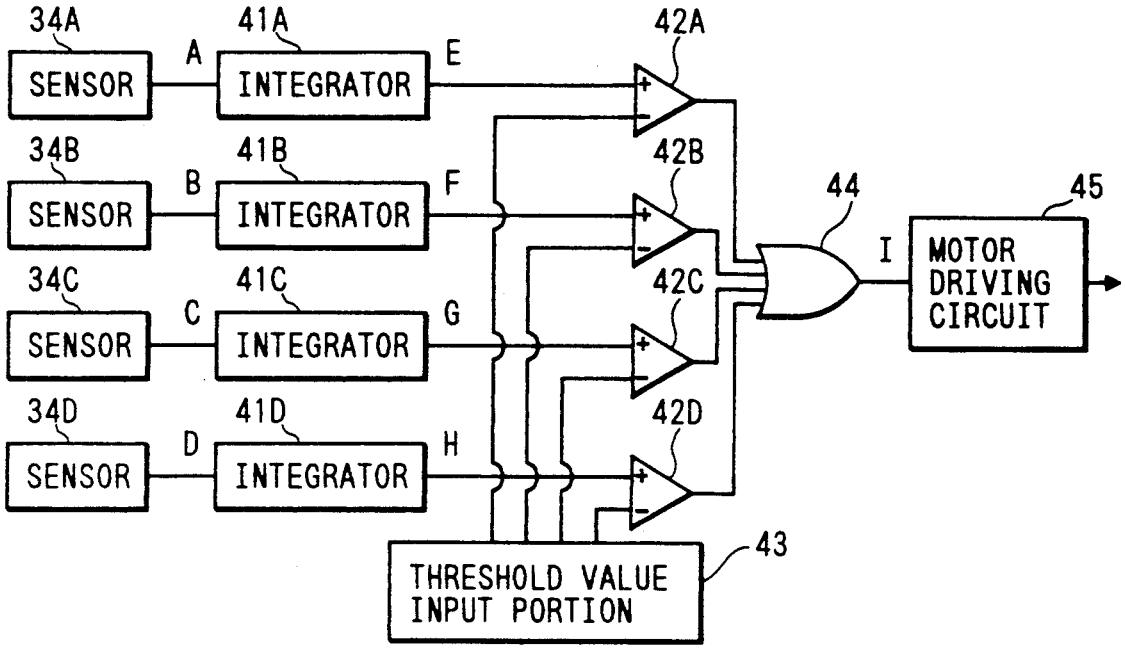
FIG. 9 is a block diagram of a control circuit according to the first embodiment of the invention.

FIG. 9 is a block diagram of a control circuit 9.

As shown in FIG. 9, integrators 41A, 41B, 41C and 41D receive detection signals A, B, C and D output from the magnetic sensors 34A, 34B, 34C and 34D, respectively, and convert them into triangular waves E, F, G, and H which are supplied to comparators 42A, 42B, 42C and 42D, respectively. Each of the comparators 42A, 42B, 42C and 42D receives a signal from a threshold value input portion 43 representing a threshold value according to the inclination angle of the rotating propeller 1. The comparators output a pulse wave having a pulse width which is determined in accordance with the input threshold value. Each of the outputs of the comparators 42A, 42B, 42C and 42D are supplied to an OR gate circuit 44, and a motor driving circuit 45 is operated to rotate the motor 2 in response to an output signal I of the OR gate circuit 44.

Figure 10:
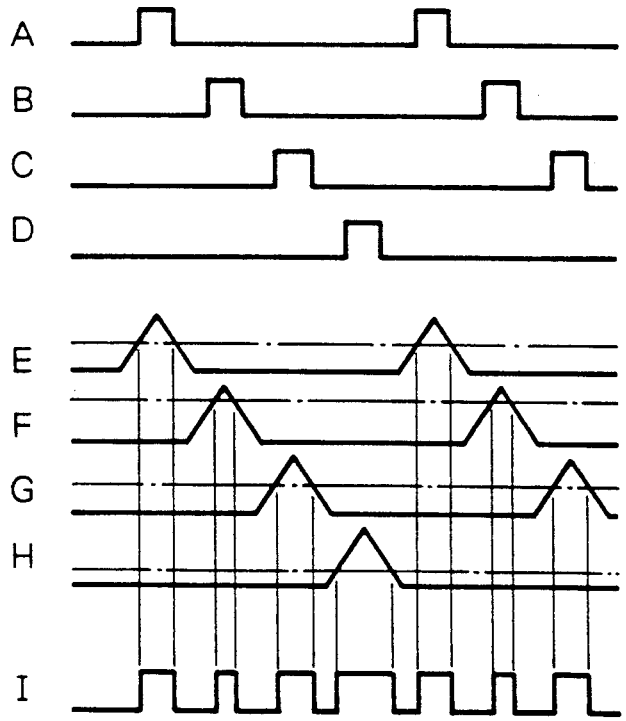
FIG. 10 is a timing chart of the signals operated in the control circuit shown in FIG. 9.

FIG. 10 is a timing chart of the signals operated in the control circuit 9.

The left position sensor 34A outputs a pulse wave acting as a detection signal A when the blade 12 comes to a position at the leftside of the fuselage 8. Similarly, the front position sensor 34B, right position sensor 34C and rear position sensor 34D output a pulse wave when the blade 12 comes to position at the frontside, rightside and rearside of the fuselage 8, respectively.

The detection signals A, B, C and D generated by the magnetic sensors 34A, 34B, 34C and 34D are shaped by the integrators 41A, 41B, 41C and 41D which produce the triangular waves E, F, G and H, respectively.

The threshold value output to the comparators 42 from the threshold value input portion 43 is determined in accordance with the inclination angle of the tip path plane of the rotating propeller 1. If the four threshold values supplied to the four comparators 42A, 42B, 42C and 42D are equal to one another, the pulse wave output signal of each of the comparators has the same pulse width and, in this case, the rotations of the blades 12 and 13 are equal in pitch to each other to produce the propulsive force in a direction parallel to the rotation shaft 5.

For example, as indicated by the dot-and-dash lines in FIG. 10, if a threshold value applied to the signal F for the blade 12 positioned at the frontside of the fuselage 8 is set larger than the others whereas a threshold value applied to the signal H for the blade 12 positioned at the rearside of the fuselage 8 is set smaller than the others, the waveform of the pulse wave I for actually driving the motor is as shown in FIG. 10. That is, the pulse width is small when the blade 12 is positioned at the frontside of the fuselage 8 and large when the blade 12 is positioned at the rearside, thereby causing a periodical eccentric rotation of the propeller 1 during one rotation thereof.

When the motor 2 is driven by a signal having the pulse width I as set forth above, while the propeller 1 is rotating clockwise, the rotational speed of the blade 12 positioned at the rearside becomes the fastest (rotational driving force becomes the largest in case that the blade has a large moment), and the degree of bend of the connecting member 7 becomes larger, so that the pitch of the blade 12 increases while that of the blade 13 decreases.

On the other hand, the degree of bend of the blade 12 is the largest when it is positioned at the leftside of the fuselage 8 since the blade 12 starts to bend upwardly owing to the increase of the buoyant force of the blade 12 itself. Further, when the blade 12 is positioned at the frontside of the fuselage 8, the pitch of the blade 12 becomes the smallest since the rotational speed (rotational driving force) is the smallest and accordingly the buoyant force decreases at that point.

In this position of the blade 12, the tip end of the blade 12 starts to go down and becomes the lowest when it is positioned at the rightside of the fuselage 8. At the same time, the tip end of the blade 13 starts to move down from the frontside position of the fuselage 8 and becomes the lowest when it is positioned at the rightside, and starts to move up from the rearside position and becomes the highest when it is positioned at the leftside of the fuselage 8.

Hence, the tip path plane of the rotating propeller 1 including the orbit of the tip end of the propeller 1 is inclined rightwardly with respect to the horizontal plane.

Since the critical position of the blades 12, 13 being the highest or lowest depends upon the speed of the motor or the flexibility of the blades, the positional relationship of the blade 12 with the magnet 33 must be adjusted accurately.

The above explanation is made in case of the rightward inclination of the tip path plane of the rotating propeller 1. However, similar control for inclining the plane in the other direction can readily be achieved by varying the threshold value applied to the comparators 42 of the control circuit 9.

The number of the magnetic sensors 34 is not limited to that of the first embodiment of the invention described above. More accurate and sensitive control can be obtained by increasing the number of the sensors. Further, the magnetic sensors are employed as a position sensor in the first embodiment, however, other kinds of sensors such as a photoelectric switches or the like may be utilized for detecting a specific position of the rotatable disc 31.

Figure 11:
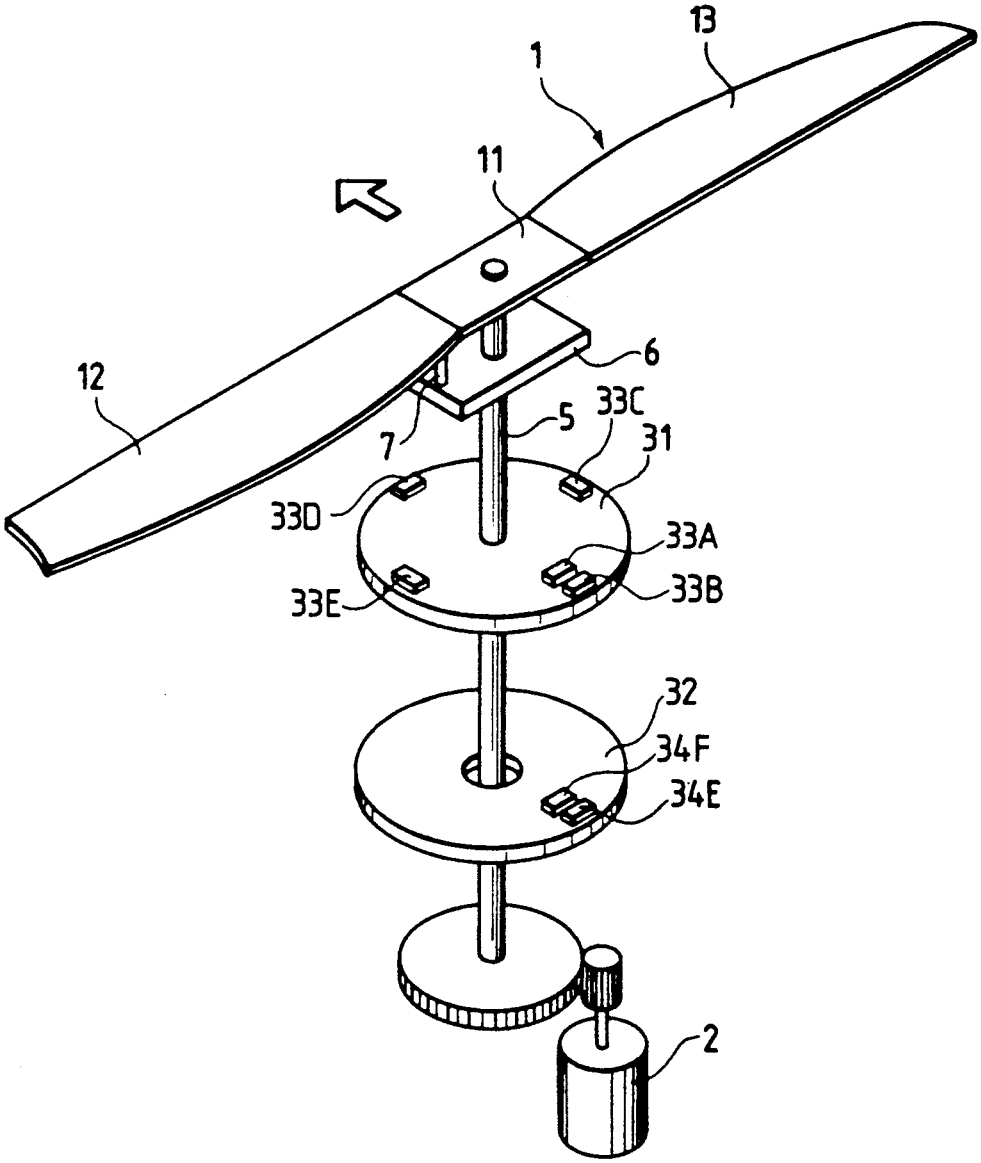
FIG. 11 is a brief schematic view showing essential parts of the device according to the second embodiment of the 5 invention.

FIG. 11 is a brief schematic view showing essential elements of the inclining device according to the second embodiment of the invention employing another arrangement of the position detector.

According to the second embodiment, as shown in FIG. 11, magnets 33B, 33C, 33D and 33E are mounted on the rotatable disc 31 which are spaced apart from one another at equal intervals, and a magnet 33A is disposed on the rotatable disc 31 at a position inward of the magnet 33B. A magnetic sensor 34E is mounted on the non-rotatable disc 32 at a position vertically aligned with the rotation orbit of the magnets 33B, 33C, 33D and 33E, whereas a magnetic sensor 34F is mounted on the non-rotatable disc 32 at a position vertically aligned with the rotation orbit of the magnet 33A. The magnetic sensor 34E outputs a detection signal when the magnets 33B, 33C, 33D and 33E approach the magnetic sensor 34E, that is, the sensor 34E generates four pulse signals during one rotation period of the rotatable disc 31. On the other hand, the magnetic sensor 34F outputs a detection signal when the magnet 33A approaches magnetic sensor 34F, that is, the sensor 34F generates one pulse signal during one rotation period of the rotatable disc 31.

Figure 12:
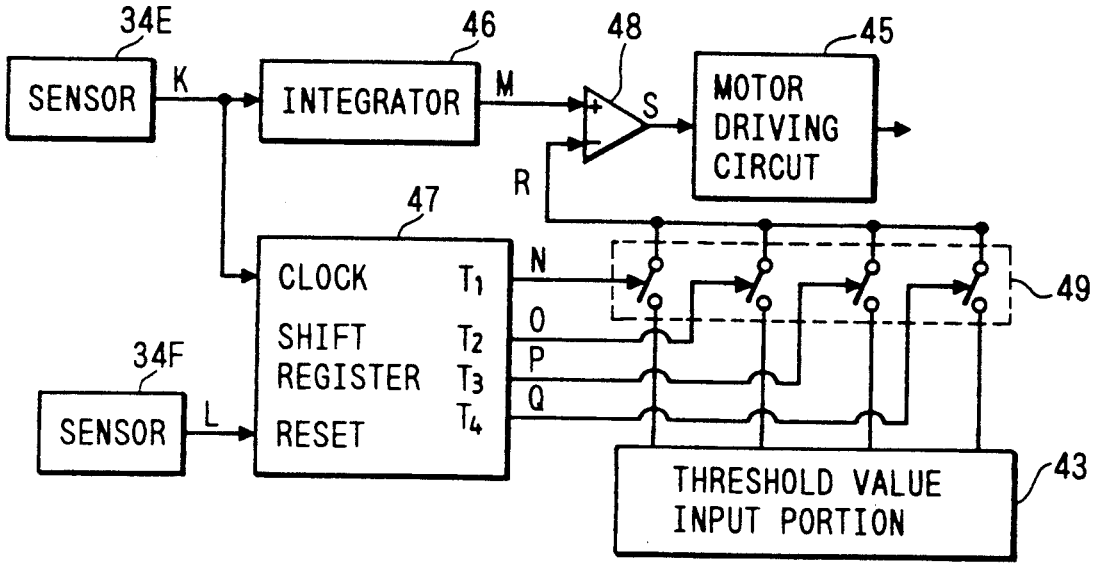
FIG. 12 is a block diagram showing the control circuit according to the second embodiment of the invention.
Figure 13:
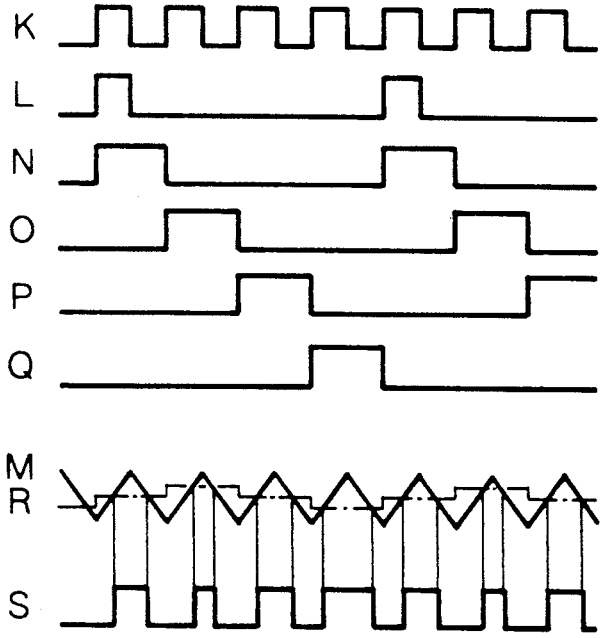
FIG. 13 is a timing chart of the control circuit shown in FIG. 12.
Figure 14:
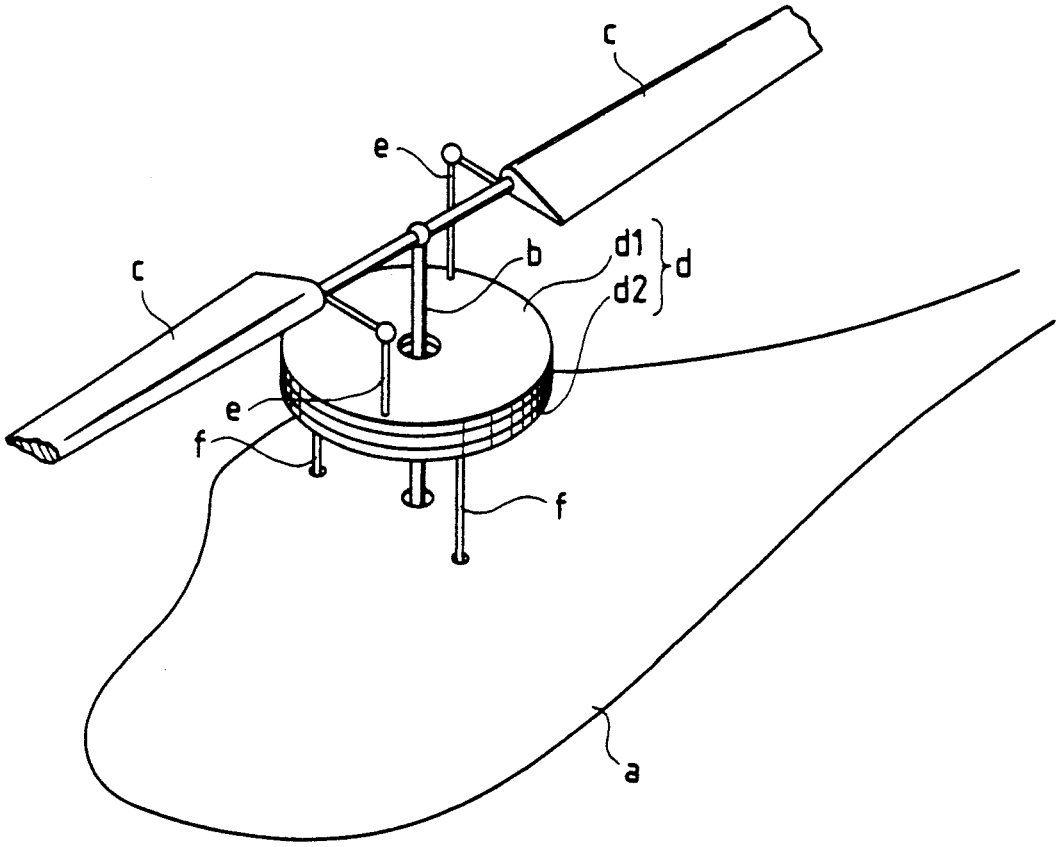
FIG. 14 PRIOR ART
FIG. 14 shows one example of the conventional device for inclining of the tip path plane of the propeller blade.

FIG. 12 is a block diagram showing the control circuit according to the second embodiment of the invention, and FIG. 13 is a timing chart of the control circuit shown in FIG. 12.

Detection signals K and L output from the magnetic sensors 34E and 34F are supplied to a clock terminal and a reset terminal of a shift register 47, respectively. The detection signal K of the magnetic sensor 34E is also supplied to an integrator 46 in which the signal is converted into a triangular wave M which is supplied to a comparator 48.

The shift register 47 is reset by the reset signal L supplied from the sensor 34F, and has an output terminal T1 which outputs a pulse signal N according to the clock pulse K supplied by the sensor 34E. Subsequently, output terminals T2, T3 and T4 of the shift register 47 output pulse signals O, P and Q, respectively, subsequent to the leading edge of following clock pulse signals. A threshold value input portion 43 outputs to the comparator 48 through analog switch 49 signals representing threshold values in accordance with an inclination angle of the tip path plane of the rotating propeller 1. The analog switch 49 is controlled to close and open by the output signals N, O, P and Q of the shift register 47 so that a threshold value signal R supplied to the comparator 48 corresponds to a position of the blades of the propeller 1. The comparator 48 converts the output signal M of the integrator 46 into a pulse wave S having a pulse width on the basis of the input threshold value signal R, and outputs the pulse wave S to the motor driving circuit 45.

FIG. 13 is a timing chart showing one example of the threshold value R indicated as a dot-and-dash line. The threshold value R shown in FIG. 13 is set, as an example, such that the threshold value is larger than the other threshold values when the blade 12 is positioned at the frontside of the fuselage 8 whereas the threshold value is smaller than the other threshold values when the blade 12 is positioned at the rearside of the fuselage 8. In this case, the pulse width of the pulse signal S is small when the blade 12 is positioned at the frontside of the fuselage 8 and large when the blade 12 is positioned at the rearside thereof, so that the tip path plane of the rotating propeller 1 is inclined rightwardly as the aforesaid operation of the first embodiment.

The threshold value output from the threshold value input portion 43 is varied appropriately to incline the tip path plane of the rotating propeller 1 in a desired direction.

The actual position of the magnets 33 and magnetic sensors 34 as well as the number thereof are not limited to or by the second embodiment described above.

According to the second embodiment of the invention, the employed magnetic sensors 34 are reduced in number and the control circuit 9 is simplified, so that the device can be assembled easily and accurately and, therefore, the manufacturing cost can effectively be reduced.

Further, other kinds of sensors such as photoelectric switches or the like may be employed for detecting a specific position of the rotatable disc 31 instead of the magnetic sensors 34.

The device for inclining the tip path plane may be applied, other than a toy helicopter, to a toy flying object having a propeller for generating a buoyant force and means for generating a force directing opposite to the direction of a reverse torque of the propeller, such as a flying toy having a plurality of propellers rotating in reverse direction to each other.

The device for inclining a tip path plane of rotating propeller for use in a toy having the propeller constructed as described above can reduce the number of component parts to achieve a small-sized and lightweight design, and the cost is low.

Further, since the control for inclining the tip path plane of the rotating propeller can be obtained merely by an electrical control, the possibility of mechanical damages can be reduced and the simple and accurate control can be achieved, resulting another reduction of the manufacturing cost.

What is claimed is:

1. A propeller blade tip path plane-inclining device for a toy flying object having a rotation shaft, comprising:

a propeller comprising:

a center piece rotating unit rotating with said rotation shaft; and a plurality of blades extending substantially horizontally from said center piece rotating unit, wherein a variation in pitch during rotation is different for each of said plurality of blades;

a motor for driving said propeller to rotate;

means for detecting a position of said propeller; and means for controlling said motor in accordance with an output signal of said means for detecting the position of said propeller;

wherein said propeller blade tip path plane-inclining device further includes a connecting member for connecting said center piece rotating unit of said propeller to the rotation shaft at a point eccentric from a center point of said center piece rotation unit, said connecting member being formed of a flexible material.

2. The propeller blade tip path plane-inclining device of claim 1, wherein said means for detecting the position of said propeller comprises;

a magnet means mounted on a rotatable disc which is mounted coaxially with the rotation shaft and rotates together with the rotation shaft; and a magnetic sensor means mounted on a non-rotatable disc fixed to a toy flying object body adjacent to said rotatable disc, said magnetic sensor means vertically aligning with said magnet means and generating a detection signal when said magnet means is within a predetermined distance from said magnetic sensor means.

3. The propeller blade tip path plane-inclining device of claim 2, wherein said magnet means comprises a single magnet, and said magnetic sensor means comprises four magnetic sensors positioned on said non-rotatable disc positioned at a leftside, frontside, rightside and rearside of the toy flying object body.

4. The propeller blade tip path plane-inclining device of claim 3, wherein said control means comprises:

an integrator means for receiving output signals of said magnetic sensors and converting said output signals into triangular wave signals;

a threshold value input means for generating a threshold value signal corresponding to an inclination angle of the tip path plane of said propeller;

a comparator means for receiving said triangular wave signals from said integrator means and said threshold value signal supplied from said threshold value input means, said comparator means outputting pulse wave signals in accordance with said threshold value signal;

an OR gate circuit for receiving said pulse wave signals from said comparator means; and a motor driving circuit for driving said motor to rotate in response to an output signal of said OR gate circuit.

5. The propeller blade tip path plane-inclining device of claim 2, wherein said magnet means comprises four magnets positioned on said rotatable disc at a location corresponding to a leftside, frontside, rightside and rearside of the toy flying object body and an additional magnet disposed at a position inward of one of said four magnets, and said magnetic sensor means comprises a first magnetic sensor vertically aligning with said four magnetics and a second magnetic sensor vertically aligning with said additional magnet.

6. The propeller blade tip path plane-inclining device of claim 5, wherein said control means comprises:

an integrator means for receiving output signals of said first magnetic sensor and for converting said output signals into triangular wave signals;

a shift register for receiving said output signals of said first magnetic sensor at a clock terminal thereof and an output signal of said second magnetic sensor at a reset terminal thereof, said shift register outputting a plurality of pulse signals corresponding to the position of said propeller;

a threshold value input means for supplying a threshold value signal corresponding to an inclination angle of the tip path plane of said propeller;

a comparator means for receiving said triangular wave signals from said integrator means and said threshold value signal supplied from said threshold value input means, said comparator means outputting a pulse wave signal in accordance with said threshold value signal;

a switch means connected between said comparator means and said threshold value input means, said switch means being operated to open and close by said pulse signals of said shift register; and a motor driving circuit for driving said motor to rotate in accordance with an output signal of said comparator means.

7. The propeller blade tip path plane-inclining device of claim 2, wherein said magnet means comprises more than four magnets.

8. The propeller blade tip path plane-inclining device of claim 2, wherein said magnetic sensor means comprises more than four magnetic sensors.

9. A propeller blade tip path plane-inclining device for a toy flying object having a rotation shaft, comprising:

a propeller comprising:

a center piece rotating unit rotating with said rotation shaft; and a plurality of blades extending substantially horizontally from said center piece rotating unit, wherein a variation in pitch during rotation is different for each of said plurality of blades;

a motor for driving said propeller to rotate;

means for detecting a position of said propeller; and means for controlling said motor in accordance with an output signal of said means for detecting the position of said propeller; wherein said propeller blade tip path plane-inclining device further includes a connecting member for connecting said center piece rotating unit of said propeller to the rotation shaft at a point eccentric from a center point of said center piece rotating unit, said connecting member being formed of a flexible material, and wherein said controlling means generates pulse wave signals for driving said motor to incline a tip path plane of said plurality of blades by varying the pulse width of said pulse wave signals for a predetermined time during one rotation of said propeller.

10. A propeller blade tip path plane-inclining device for a toy flying object having a rotation shaft, comprising:

a propeller comprising:

a center piece rotating unit rotating with said rotation shaft; and a plurality of blades extending substantially horizontally from said center piece rotating unit, wherein a variation in pitch during rotation is different for each of said plurality of blades;

a motor for driving said propeller to rotate;

means for detecting a position of said propeller; and means for controlling said motor in accordance with an output signal of said means for detecting the position of said propeller;

wherein said propeller blade tip path plane-inclining device further includes a connecting member for connecting said center piece rotating unit of said propeller to the rotation shaft at a point eccentric from a center point of said center piece rotating unit, said connecting member being formed of a flexible material, and a rotation piece connecting to said center piece rotating unit of said propeller by means of said connecting member secured to said center piece rotating unit at an eccentric position with respect to the rotation shaft, said rotation piece rotating together with the rotation shaft.

11. A propeller blade tip path plane-inclining device for a toy flying object having a rotation shaft, comprising:

a propeller comprising:

a center piece rotating unit rotating with said rotation shaft; and a plurality of blades extending substantially horizontally from said center piece rotating unit, wherein a variation in pitch during rotation is different for each of said plurality of blades;

a motor for driving said propeller to rotate;

means for detecting a position of said propeller; and means for controlling said motor in accordance with an output signal of said means for detecting the position of said propeller;

wherein said center piece rotating unit of said propeller is provided with a through hole for allowing said propeller to pivot, said through hole being formed at a center portion of said center piece rotating unit, and an inner surface of said through hole being in contact with an outer surface of the rotation shaft.

12. The propeller blade tip path plane-inclining device of claim 11, wherein said means for detecting the position of said propeller comprises a photoelectric switch.

* * * * *